US007530841B2

(12) United States Patent
Henningsen

(10) Patent No.: US 7,530,841 B2
(45) Date of Patent: May 12, 2009

(54) COAXIAL ANGLE CONNECTOR

(75) Inventor: Jimmy Ciesla Henningsen, Holmegaard (DK)

(73) Assignee: Corning Cabelcon A/S, Naestved (DK)

( * ) Notice: Subject to any disclaimer, the term of this patent is extended or adjusted under 35 U.S.C. 154(b) by 0 days.

(21) Appl. No.: 10/572,198

(22) PCT Filed: Sep. 15, 2003

(86) PCT No.: PCT/DK03/00596

§ 371 (c)(1),
(2), (4) Date: Mar. 15, 2006

(87) PCT Pub. No.: WO2005/027276

PCT Pub. Date: Mar. 24, 2005

(65) Prior Publication Data

US 2007/0082510 A1 Apr. 12, 2007

(51) Int. Cl.
*H01R 9/05* (2006.01)

(52) U.S. Cl. ..... 439/578

(58) Field of Classification Search ..... 439/578, 439/585, 582

See application file for complete search history.

(56) References Cited

U.S. PATENT DOCUMENTS

| | | | | | |
|---|---|---|---|---|---|
| 2,335,041 | A * | 11/1943 | Bruno | 174/87 |
| 2,813,144 | A * | 11/1957 | Valach | 174/87 |
| 3,432,798 | A * | 3/1969 | Brishka | 439/322 |
| 3,731,378 | A * | 5/1973 | Toma et al. | 29/879 |
| 4,861,271 | A * | 8/1989 | Bogar et al. | 439/63 |
| 4,881,912 | A * | 11/1989 | Thommen et al. | 439/585 |
| 5,061,206 | A * | 10/1991 | Kawanami et al. | 439/582 |
| 5,230,640 | A * | 7/1993 | Tardif | 439/578 |
| 5,651,699 | A * | 7/1997 | Holliday | 439/585 |
| 5,725,391 | A * | 3/1998 | Masuda et al. | 439/582 |
| 6,126,482 | A * | 10/2000 | Stabile | 439/582 |
| 6,283,790 | B1 * | 9/2001 | Idehara et al. | 439/582 |

FOREIGN PATENT DOCUMENTS

| | | |
|---|---|---|
| DE | 199 04 574 | 2/1999 |
| EP | 0 090 538 | 5/1983 |
| EP | 0 920 088 | 6/1999 |
| FR | 1 500 295 | 9/1966 |
| WO | WO 96/31925 | 4/1996 |

* cited by examiner

*Primary Examiner*—T C Patel
*Assistant Examiner*—Vladimir Imas
(74) *Attorney, Agent, or Firm*—Joseph M. Homa; Matthew J. Mason

(57) ABSTRACT

A right angle coaxial connector comprises a unitary body, (1) having a dielectric insulating member (4) secured along a longitudinal tubular bore extending along axis F-F through said unitary body (1) and holding a predominantly longitudinal inner conductor (2), having male ends (2A, 2B), in its correct position along the bore's central axis F-F with an integral perpendicular node (2B) lying along the axis E-E, a shell (6) extending along a lateral axis E-E having dielectric insulating member (8) secured along a lateral tubular bore extending through said shell (6) and holding a lateral inner conductor (7) having female ends (7A, 7B), where said unitary body (1) and shell (6) are fixably joined at a pair of interfaces (B, C) and the corresponding male (2B) and female (7A) ends of the respective inner terminals (2, 7) are releasably attached to one another.

20 Claims, 2 Drawing Sheets

COAXIAL ANGLE CONNECTOR

CLAIM TO PRIORTY

The application claims the benefit of priority under 35 U.S.C. §365 of International Patent Application Serial No. PCT/DK03/00596 filed on Sep. 15, 2003 designating the United states of America.

TECHNICAL FIELD

The present invention relates generally to a connector for coaxial cables or more particularly to an angled coaxial connector which allows an angled arrangement between an attached coaxial cable and a mating port.

BACKGROUND OF THE INVENTION

Current connectors on the market have a number of disadvantages and have to be assembled and adjusted in a time-consuming manner.

U.S. Pat. No. 2,813,144 discloses a connector with a central conductor with reduced inner end portion which is bent at right angles and brazed or soldered into the end bore of a conductor while EP 0090538 describes an angle connector where a ferrule section is crimped onto a central conductor. Both these methods of connecting the two perpendicular connectors have the disadvantage of doing so in a rigid manner. Firstly, the rigid connection must be made and this requires access to the perpendicular connection so that the crimping, brazing or soldering can take place. Thus, access must be provided and hermetically sealed which increases the complexity of the parts manufactured as well as adding complications to the whole assembly process. Secondly, a rigid connection is disadvantageous because any displacement of either the plug-end or jack-end interfaces could result in the perpendicular connection bending or breaking resulting in a loss or at best a deterioration of contact.

U.S. Pat. No. 2,813,144, EP 0090538 and EP 0920088 all disclose the use of a dielectric material to insulate the area between the inner conductor and the surrounding shell. In these examples, the dielectric material surrounds nearly the entire length of the inner conductor which results in large signal losses and is very disadvantageous.

SUMMARY OF THE INVENTION

The object of the present invention is to provide a robust yet easily assembled angled coaxial cable connector which doesn't suffer from intermodulation problems or excessive signal loss.

This object is attained according to the present invention by a coaxial connector device comprising a first and a second connector section with first and second longitudinal axes, respectively, said first section comprising a coaxially disposed first inner terminal for releaseable mechanical and electrical connection to a coaxially disposed second inner terminal or the second connector section, where the first and second inner terminals are provided with mutually corresponding contact means for the establishment of a releasable contact between first and second inner terminals.

The longitudinal axes of said first and second connector sections extend at an angle relative to each other, which angle according to a preferred embodiment of the invention is substantially 90°, although any other angle would also be covered by the scope of the invention as defined by the independent claim.

The invention can be thought of as consisting of two distinct parts, a part having two plug-end interfaces and a part having two jack-end interfaces although it should be noted that this is not necessarily the case, as an inner terminal can certainly have one male end and one female.

A first section is comprised of a nut rotating about a central axis and tightening against a unitary body which is generally a tubular shell having two linked bores, one longitudinal and one lateral, and within which is disposed a predominantly longitudinal inner terminal having two male ends, which is held in its correct position by a dielectric insulating ring.

A second section is comprised of an outer tubular shell having two axially aligned longitudinally linked bores with a tubular dielectric insulator securing an inner terminal, having two female ends, along a central lateral axis.

The invention does not require any form of soldering, brazing or crimping to be carried out and thus eliminates the need for the associated tools to be carried and used, saving time and making the whole assembly process simpler. The predominantly longitudinal inner terminal is exposed at both ends and has a tapered narrowing at the connector's plug end and an integral perpendicularly aligned node at its other end giving it two male ends that are perpendicular to one another. The lateral inner terminal is located in the second section and has two female ends, one end forming part of the connector's cable-receiving end and the other being coupled with and along the same axis as the integral perpendicularly aligned node of the predominantly longitudinal inner terminal when the two sections are fixed together. Thus, the connection between the two inner terminals is not permanently rigid and the male node has a freedom to move longitudinally within the corresponding jack without a loss in contact between the two. This is particularly advantageous if either inner conductor suffers any longitudinal or lateral pressure as a certain displacement tolerance is allowed without permanent deformation or a loss of contact.

No other tools are required to bring the two sections together as the thread disposed around the outer circumference of one end of the narrower jack-end interface second section may be screwed in to the first section which couples with the corresponding receiving spindle located on the inner circumference of the laterally aligned plug-end interfaced bore or vice-versa, thus giving a very tight and firm mechanical connection which reduces the risk and extent of any intermodulation.

Alternatively, the two sections can be brought together where the second section can simply "snap" into the first section and be held firmly in place by a ridge which is accommodated by a receiving groove located along the same interfaces as mentioned in the previous embodiment.

A pair of tubular dielectric insulators ensure that the inner terminals are kept from the corresponding shell and unitary body or outer terminals. They are relatively narrow with one insulator being disposed along a central axis within the unitary body and the other secured by the narrower bore of the shell. A thin angled insulating cone is also present at the jack section's cable-receiving end which also acts to guide the cable's inner conductor into the receiving jack. These narrow insulators do not lead to a loss in signal and are therefore preferred.

DETAILED DESCRIPTION OF THE INVENTION

Figure 1:
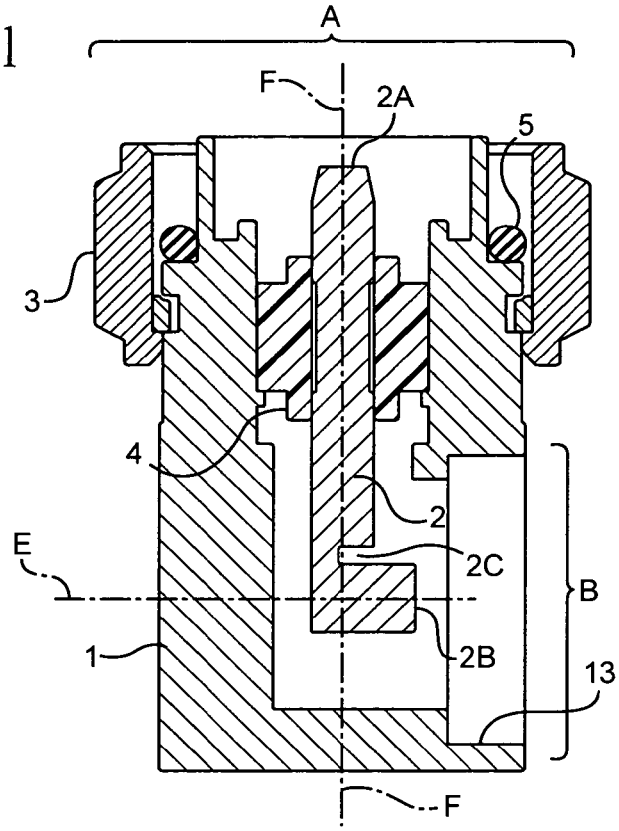
FIG. 1 is a cut-away side view of a plug section of an angled coaxial connector.

FIG. 1 illustrates an embodiment of a connector according to the invention, where a nut 3 is rotatable about a unitary body piece 1 at a plug-end interface A and an inner terminal 2 is held in its correct position along a longitudinal axis F-F within the central bore of the unitary body 1 and insulated from said unitary body 1 by a dielectric insulating tube 4.

The inner terminal 2 extends from the plug-end interface A along the axis F-F until the axis E-E. Here the inner terminal 2 is formed in such a way that an integral tubular node 2B extends along the axis E-E towards the plug-end interface B. The node is separated from a proportion of the inner terminal's main shaft by a gap 2C which extends about halfway into the inner terminal's longitudinal shaft. Also located at the plug-end interface B is a receiving spindle 13 which is located on the inner circumference of the laterally aligned bore for the receipt and securing of a corresponding screw thread 12 located on the jack section. An O-ring made of a suitable material is disposed between the nut 3 and the unitary body 1 to ensure a moisture-proof seal between the unitary body 1 and outer terminal of an inserted female plug.

Figure 2:
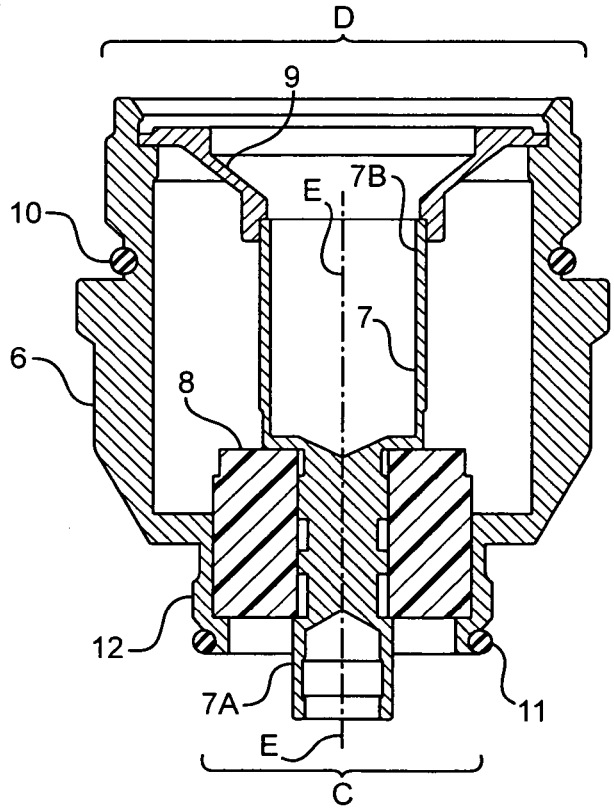
FIG. 2 is a cut-away side view of a jack section of an angled coaxial connector.

FIG. 2 illustrates the second part of an embodiment according to the invention where a main tubular shell 6 is comprised of two integrated tubular sections with differing inner and outer diameters running along the same lateral axis. The shorter narrower tube at a jack-end interface C is joined to the broader tube by a short perpendicular step from where the broader tube runs until a jack-end interface D. Along this central axis E-E, an inner terminal 7 having two female jack ends lies surrounded at the jack-end interface C by a tubular dielectric insulator 8. A cable-receiving jack end 7B is the larger of the two jack ends and accommodates a cable's inner conductor. The tubular shell at the jack-end interface D also has a larger diameter than that of the opposite jack-end interface C and the outer circumference is shaped so as to ensure contact with the inner surface of a cable's outer conductor. An O-ring 10 ensures a moisture proof seal between said outer conductor and the tubular shell 6. A tubular dielectric insulator 8 is disposed within the narrowed shell 6 and secures the inner terminal 7 in place while the cone-shaped insulator is disposed at the jack-end interface D and ensures the correct positioning of the cable-receiving jack end 7B and that the exposed inner conductor of a prepared coaxial cable end is guided into said cable-receiving jack 7B.

Figure 3:
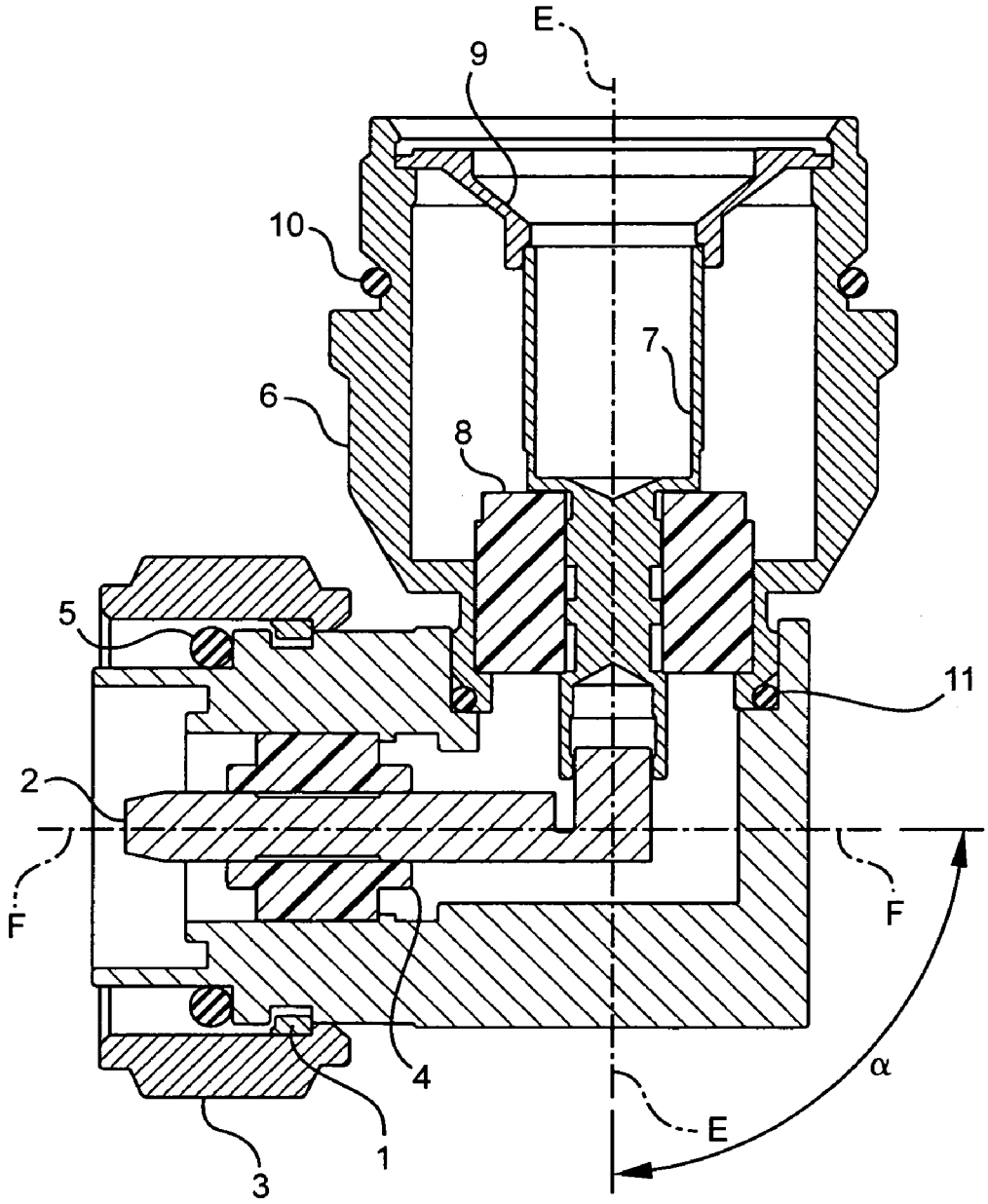
FIG. 3 is a cut-away side view of the attached and assembled plug and jack sections of an angled coaxial connector.

FIG. 3 illustrates the assembled and completed embodiment of the invention where the plug-end interface C is inserted into and coupled with the plug end interface B of the unitary body 1 and the node-receiving jack end 7A is able to engage the integral node 2B. The narrowed section of the shell 6 at the jack-end interface C is flexible enough to allow a slight inward deformation to enable said narrowed section to be engaged by the plug-end interface B and screw into position with a screw thread 12 fitting into the corresponding receiving spindle 13 and trapping an O-ring between the unitary body 1 and the shell 6 to form a moisture-proof seal. This effectively locks the shell 6 in position and hinders any lateral movement of it in respect of the unitary body 1. The integral node-receiving jack end 7A may have a plurality of lateral slits to enable the resulting fingers to dilate the jack ends effective diameter to accommodate and grip the corresponding integral node 2B.

Another embodiment of the invention is for the first section 1 to contain an inner terminal 2 having two female ends and a second section 6 having an inner terminal 7 with two male ends. Or altematively, another embodiment would see the first section 1 having an inner terminal 2 with one male and one female end and the second section 6 having an inner terminal 7 also with one male and one female end. Indeed, any combination can be considered providing that the exposed inner terminal ends 2A, 7B are not the same gender and the internally connected inner terminal ends 2B, 7A are not the same gender.

In another embodiment of the invention, the relationship between the two axes is not perpendicular. Indeed, it may have any angular relationship desired to one another.

In a further embodiment of the invention, the screw thread 12 can be replaced by a locking ridge and the receiving spindle 13 can be replaced by locking groove. Thus, the first and second sections can be "snapped" together giving a secure mechanical and electrical connection between the two sections. It should also be noted that the first section may house the locking groove 13 and the second section may house the locking ridge 12.

In a further embodiment, the angled connector is comprised of a first, second and third section, thus forming a T-connector where the connection between the inner terminals employs the same non-fixed and releasably attached form of connection. Indeed, a plurality of sections comprising central inner conductors could be connected in this way.

The invention claimed is:

1. A coaxial connector comprising:

a first section comprising:

a unitary body comprising:

a tubular portion disposed about a first axis, the tubular portion having an inner surface and an outer surface, the inner surface defining a first bore disposed about the first axis, and an angled portion having an inner surface defining a second bore disposed about a second axis, the second axis intersecting the first axis;

an insulating tube disposed within the body and contacting the inner surface of the body, the insulating tube being disposed within the first bore and having an inner surface and an outer surface, the outer surface of the insulating tube contacting the inner surface of the tubular portion of the body; and a first inner terminal disposed within the body, the inner terminal comprising a first portion and a second portion, the first portion extending along the first axis disposed within the first bore and contacting the inner surface of the insulating tube, and the second portion extending along the second axis disposed within the second bore, said second portion defining an integral angled node; and a second section mated with the first section, the second section comprising:

a tubular shell disposed about the second axis and comprising an inner surface;

a tubular insulator disposed within and contacting the tubular shell; and a second inner terminal disposed within and contacting the tubular insulator, the second inner terminal comprising a first portion and a second portion;

wherein the angled portion of the body matingly engages the tubular shell; and wherein the second portion of the first inner terminal releasably contacts the first portion of the second inner terminal.

2. The connector of claim 1 wherein the first section is releasably attached to the second section.

3. The connector of claim 1 wherein the first inner terminal is capable of moving longitudinally along the second axis without losing contact with the second inner terminal.

4. The connector of claim 1 wherein the angled portion of the body threadedly engages the tubular shell.

5. The connector of claim 1 wherein the angled portion of the body comprises a locking ridge and the tubular shell comprises a locking groove adapted to receive the locking ridge.

6. The connector of claim 1 wherein the tubular shell comprises a locking ridge and the angled portion of the body comprises a receiving groove adapted to receive the locking ridge.

7. The connector of claim 1 further comprising a nut disposed on the outer surface of the tubular portion of the body.

8. The connector of claim 1 further comprising a conical guide disposed within the tubular shell and contacting the second inner terminal.

9. The connector of claim 1 wherein the first inner terminal comprises a recess adapted to receive the first end of the second inner terminal.

10. The connector of claim 1 wherein a second end of the second inner terminal is adapted to receive a central conductor of a coaxial cable.

11. The connector of claim 1 wherein the first and second axes extend at an angle ($\alpha$) relative to each other.

12. The connector of claim 11 wherein the angle ($\alpha$) is substantially 90 degrees.

13. The connector of claim 1 wherein the first portion of the first inner terminal comprises a male end.

14. The connector of claim 1 wherein the second portion of the first inner terminal comprises a male end.

15. The connector of claim 1 wherein the second portion of the first inner terminal comprises a female end.

16. The connector of claim 1 wherein the first portion of the first inner terminal comprises a female end.

17. The combination of a first coaxial connector section and a second coaxial connector section, wherein the first coaxial connector section comprises:

a body comprising:

a tubular portion disposed about a first axis, the tubular portion having an inner surface and an outer surface, the inner surface defining a first bore disposed about the first axis, and an angled portion having an inner surface defining a second bore disposed about a second axis, the second axis intersecting the first axis;

an insulating tube disposed within the body and contacting the inner surface of the body, the insulating tube being disposed within the first bore and having an inner surface and an outer surface, the outer surface of the insulating tube contacting the inner surface of the tubular portion of the body; and a first inner terminal disposed within the body, the inner terminal comprising a first portion and a second portion, the first portion extending along the first axis disposed within the first bore and contacting the inner surface of the insulating tube, and the second portion extending along the second axis disposed within the second bore, said second portion defining an integral angled node; and wherein the second coaxial connector section is adapted to mate with the first section, the second coaxial connector section comprising:

a tubular shell disposed about the second axis and comprising an inner surface;

a tubular insulator disposed within and contacting the tubular shell; and a second inner terminal disposed within and contacting the tubular insulator, wherein the angled portion of the body is adapted to matingly engage the tubular shell; and wherein the first inner terminal is adapted to releasably contact the second inner terminal.

18. The connector of claim 10 wherein no dielectric material surrounds the second end of the second inner terminal.

19. The connector of claim 17 wherein a second end of the second inner terminal is adapted to receive a central conductor of a coaxial cable, and no dielectric material surrounds the second end of the second inner terminal.

20. The connector of claim 1 wherein the insulating tube does not contact the tubular insulator.

* * * * *